US005159801A

United States Patent [19]

Schmidt

[11] Patent Number: 5,159,801

[45] Date of Patent: Nov. 3, 1992

[54] MORTAR SECURING BUILDING BRICK

[76] Inventor: Karl Schmidt, 314 Beechwood Rd., Wilmington, Ohio 45177

[21] Appl. No.: 806,231

[22] Filed: Dec. 13, 1991

[51] Int. Cl.[5] ..... E04C 1/00

[52] U.S. Cl. ..... 52/575; 52/606; 52/607; 52/604; 52/609; 52/593; 52/439; D25/116

[58] Field of Search ..... 52/562, 564, 565, 575, 52/576, 604, 605, 606-612, 415, 421, 425, 424, 439, 442, 593; D25/113, 114, 115, 116, 118

[56] References Cited

U.S. PATENT DOCUMENTS

| | | | |
|---|---|---|---|
| 295,692 | 3/1884 | Trochslee | 52/610 |
| 1,503,059 | 9/1924 | Moroso | 52/439 |
| 1,662,300 | 3/1928 | Covell | 52/425 |
| 2,493,547 | 1/1950 | Paolella et al. | 52/605 |
| 2,624,193 | 1/1953 | Larson | 52/575 |
| 4,040,225 | 8/1977 | Bretone | 52/605 X |
| 4,887,403 | 12/1989 | Bonner | 52/605 X |
| 4,909,010 | 3/1990 | Gravier | 52/609 |
| 4,956,958 | 9/1990 | Caroti | 52/605 |
| 5,072,566 | 12/1991 | Zeidman | 52/605 X |

FOREIGN PATENT DOCUMENTS

| | | | |
|---|---|---|---|
| 1214748 | 11/1959 | France | 52/439 |
| 0002046 | 1/1795 | United Kingdom | 52/575 |

*Primary Examiner*—David A. Scherbel
*Assistant Examiner*—Robert Canfield
*Attorney, Agent, or Firm*—Leon Gilden

[57] ABSTRACT

A building brick includes a through-extending bore of a trapezoidal cross-sectional configuration to ease removal of a building brick from a mold during fabrication. The central bore permits the stacking of the building bricks to include the bottom wall in downward orientation to accommodate a greater quantity of mortar at the base portion thereof for a stable mortar configuration in use. A further embodiment of the invention includes the bottom wall of a concave configuration to assist in the positioning of mortar between adjacent building bricks, as well as a further embodiment including a forward wall flange extending downwardly relative to the concave surface and a second end wall flange to assist in the positioning of mortar between adjacent bricks to secure the mortar in a semi-solid state.

2 Claims, 4 Drawing Sheets

MORTAR SECURING BUILDING BRICK

BACKGROUND OF THE INVENTION

1. Field of the Invention

The field of invention relates to building brick construction, and more particularly pertains to a new and improved mortar securing building brick wherein the same is arranged for the securement of mortar between adjacent building bricks during their use.

2. Description of the Prior Art

Building bricks of various types are utilized throughout the prior art to secure mortar relative to the building bricks in the construction trade. Such building brick construction is exemplified in U.S. Pat. No. 4,963,305 to Cromrich utilizing a building brick with an insulated outer face.

U.S. Pat. No. 3,436,238 to Criss sets forth a refractory brick formed of a predetermined hegregate.

U.S. Pat. No. 4,824,811 to Lang, et al. sets forth a light-weight ceramic material for use as a building brick.

U.S. Pat. No. 4,956,958 to Caroti sets forth building bricks utilizing inter-fitting top and bottom wall configurations.

As such, it may be appreciated that there continues to be a need for a new and improved mortar securing building brick as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of building bricks now present in the prior art, the present invention provides a mortar securing building brick wherein the same utilizes flange constructions integral with a brick to secure mortar during use of the bricks in construction of walls and the like. As such, the general purpose of the present invention, which will be described subsequently in greater detail, is to provide a new and improved mortar securing building brick which has all the advantages of the prior art building bricks and none of the disadvantages.

To attain this, the present invention provides a building brick including a through-extending bore of a trapezoidal cross-sectional configuration to ease removal of a building brick from a mold during fabrication. The central bore permits the stacking of the building bricks to include the bottom wall in downward orientation to accommodate a greater quantity of mortar at the base portion thereof for a stable mortar configuration in use. A further embodiment of the invention includes the bottom wall of a concave configuration to assist in the positioning of mortar between adjacent building bricks, as well as a further embodiment including a forward wall flange extending downwardly relative to the concave surface and a second end wall flange to assist in the positioning of mortar between adjacent bricks to secure the mortar in a semi-solid state.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially and scientists, engineers and practitioners in the art who are not familiar with patent or legal terms or phraseology, to determine quickly from a cursory inspection the nature and essence to the technical disclosure of the application. The abstract is neither intended to define the invention of the application, which is measured by the claims, nor is it intended to be limiting as to the scope of the invention in any way.

It is therefore an object of the present invention to provide a new and improved mortar securing building brick which has all the advantages of the prior art building bricks and none of the disadvantages.

It is another object of the present invention to provide a new and improved mortar securing building brick which may be easily and efficiently manufactured and marketed.

It is a further object of the present invention to provide a new and improved mortar securing building brick which is of a durable and reliable construction.

An even further object of the present invention is to provide a new and improved mortar securing building brick which is susceptible of a low cost of manufacture with regard to both materials and labor, and which accordingly is then susceptible of low prices of sale to the consuming public, thereby making such mortar securing building bricks economically available to the buying public.

Still yet another object of the present invention is to provide a new and improved mortar securing building brick which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
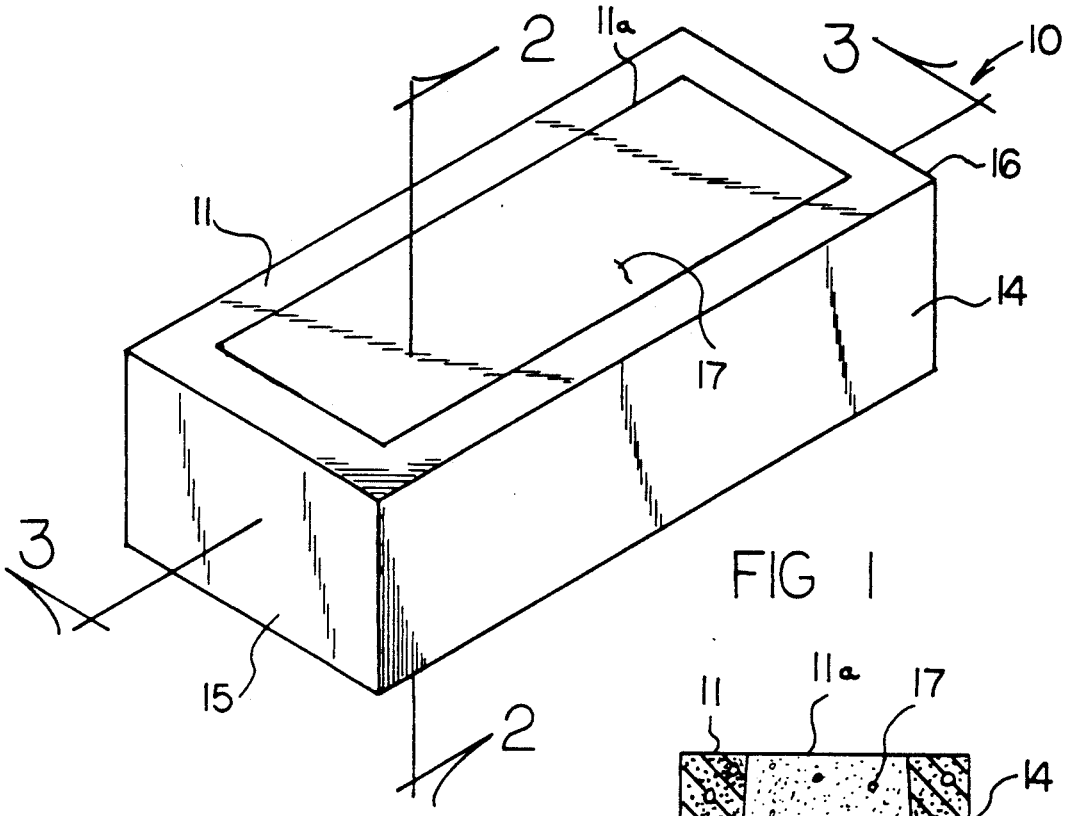
FIG. 1 is an isometric illustration of the instant invention.

With reference now to the drawings, and in particular to FIGS. 1 to 12 thereof, a new and improved mortar securing building brick embodying the principles and concepts of the present invention and generally designated by the reference numerals 10, 10*a*, and 10*b* will be described.

More specifically, the mortar securing building brick 10 of the instant invention essentially comprises a prismoidal structure to include a planar top wall 11 spaced from a planar bottom wall 12 in a parallel relationship. The top wall 11 includes a top wall opening 11*a* of a first width, with the bottom wall including a bottom wall opening of a second width greater than the first width. The opening 11*a* is defined by a first predetermined length, with the bottom wall opening defined by a second predetermined length greater than the first predetermined length to define a trapezoidal cross-sectional configuration bore 17 directed coextensively from the top wall 11 to the bottom wall 12. A first side wall 13 is spaced from and parallel a second side wall 14, with the first end wall 15 spaced from and parallel a second end wall 16. The bore 17 permits the filling of mortar 18 within the bore to provide for mortar having a center of gravity below one-half the predetermined height of the brick as defined between the bottom wall 12 and the top wall 11 to effect a stable positioning of the brick during use. Further, the bore 17 permits ease of removal of the brick structure relative to a mold during formation of the brick.

Figure 2:
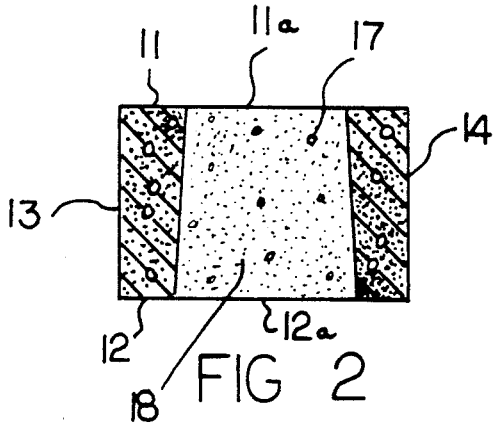
FIG. 2 is an orthographic view, taken along the lines 2—2 of FIG. 1 in the direction indicated by the arrows.
Figure 3:
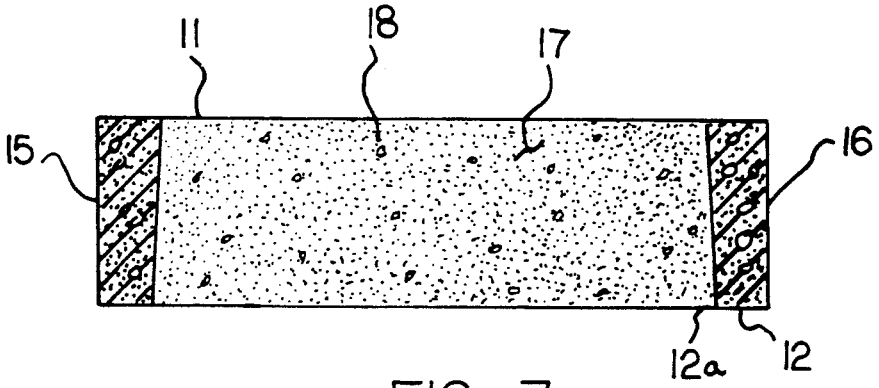
FIG. 3 is an orthographic view, taken along the lines 3—3 of FIG. 1 in the direction indicated by the arrows.
Figure 4:
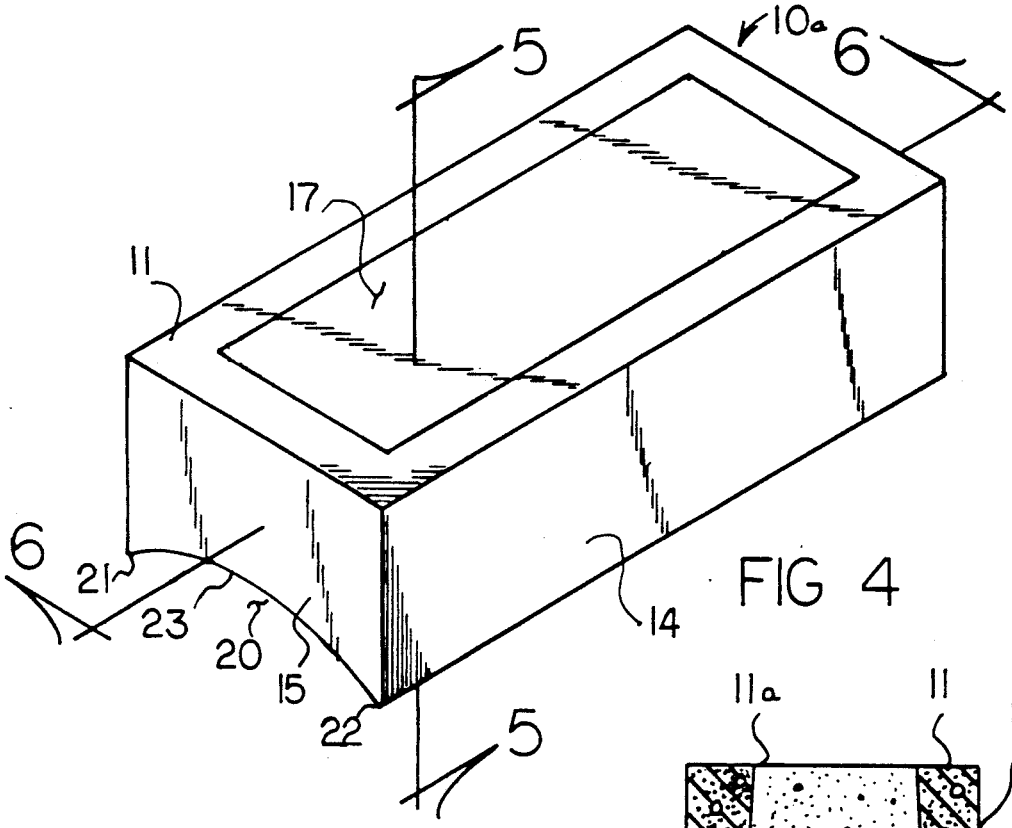
FIG. 4 is an isometric illustration of a modified brick construction of the invention.
Figure 5:
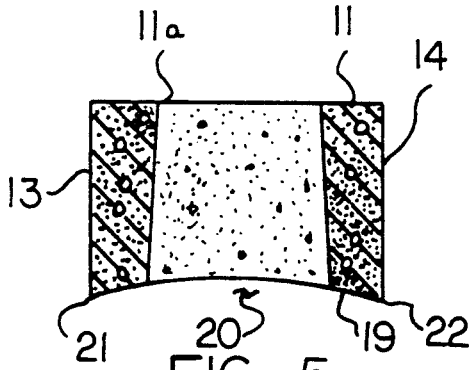
FIG. 5 is an orthographic view, taken along the lines 5—5 of FIG. 4 in the direction indicated by the arrows.
Figure 6:
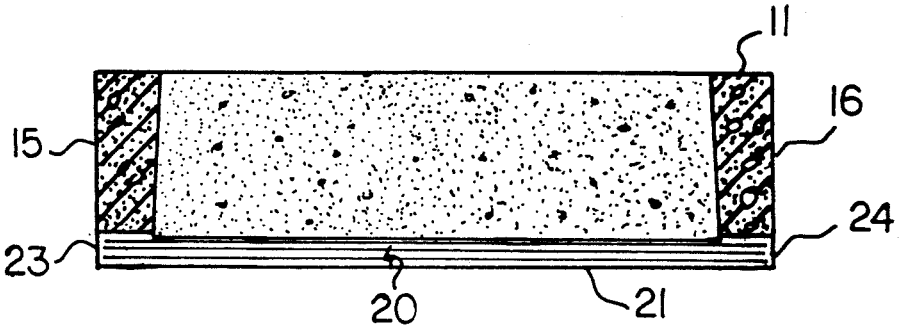
FIG. 6 is an orthographic view, taken along the lines 6—6 of FIG. 4 in the direction indicated by the arrows.

The brick 10*a*, as illustrated in the FIGS. 4–6, is essentially as that as illustrated in the FIGS. 1–3, but to include an arcuate bottom wall 19. The arcuate bottom wall 19 defines a concave cavity 20 extending from a first end wall arcuate edge 23 to a second end wall arcuate edge 24 coextensively along the length of the brick structure as the first and second end wall arcuate edges 23 and 24 are parallel. A linear first side wall bottom edge 21 is arranged in a parallel, coplanar, and coextensive relationship relative to a linear second side wall bottom edge 22. In this manner, in the stacking of the brick structure in manner as typified in FIG. 11, the mortar between the bottom wall 19 and an adjacent top wall 11 of an associated brick enhances capturing of the mortar therebetween minimizing leakage of the mortar during construction.

Figure 7:
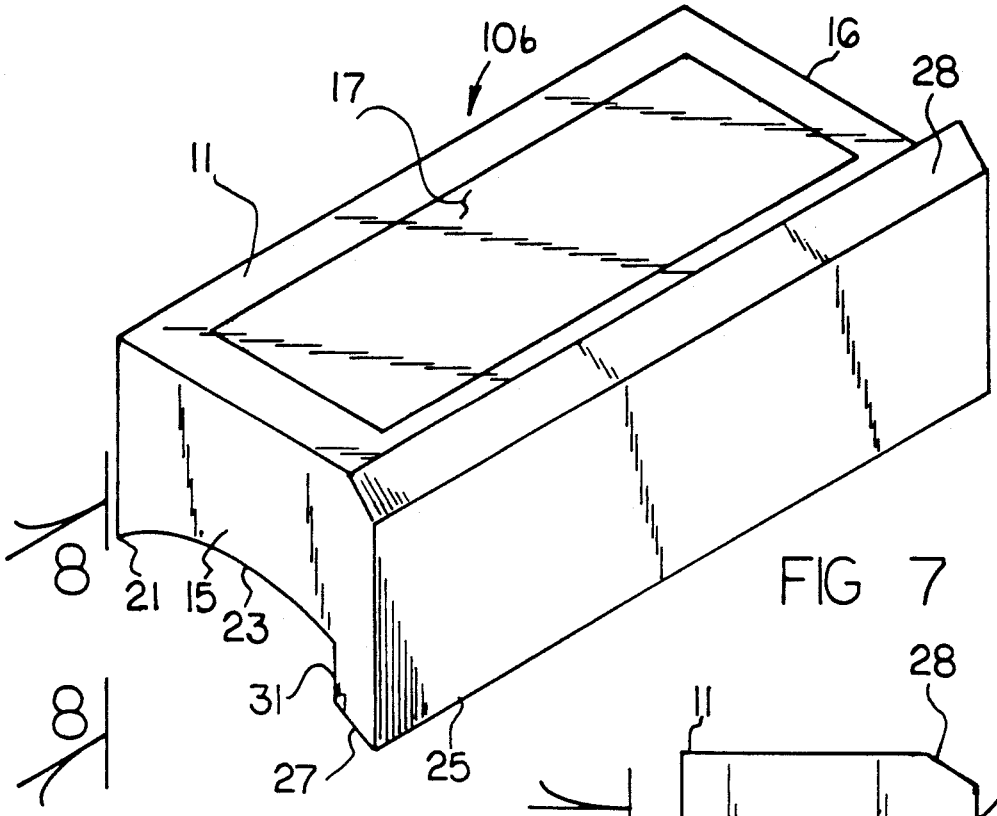
FIG. 7 is an isometric illustration of a further embodiment of the invention.
Figure 8:
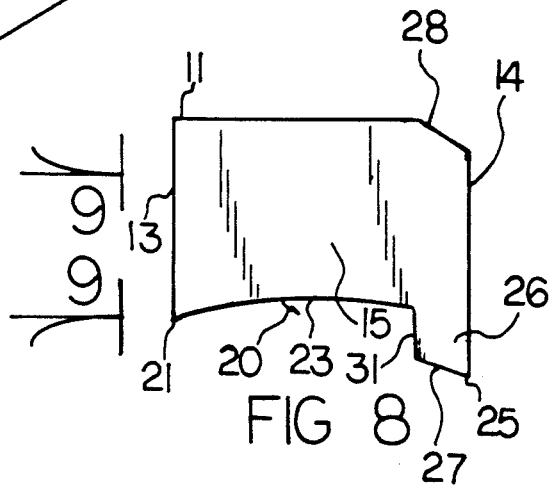
FIG. 8 is an orthographic view, taken along the lines 8—8 of FIG. 7 in the direction indicated by the arrows.
Figure 9:
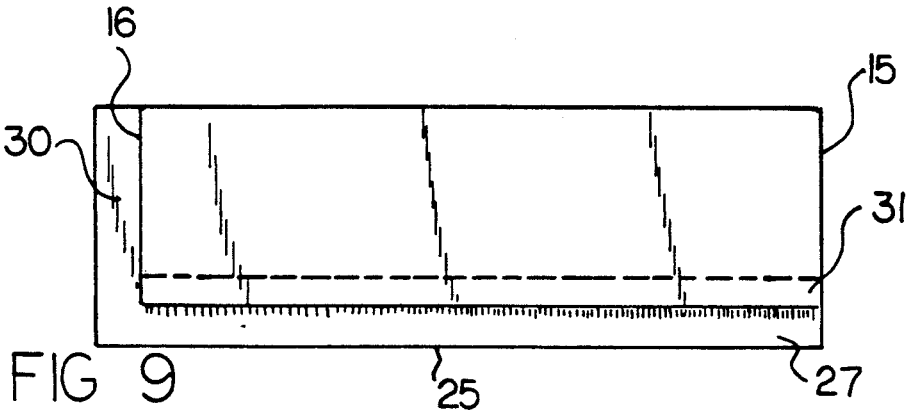
FIG. 9. is an orthographic view, taken along the lines 9—9 of FIG. 8 in the direction indicated by the arrows.
Figure 10:
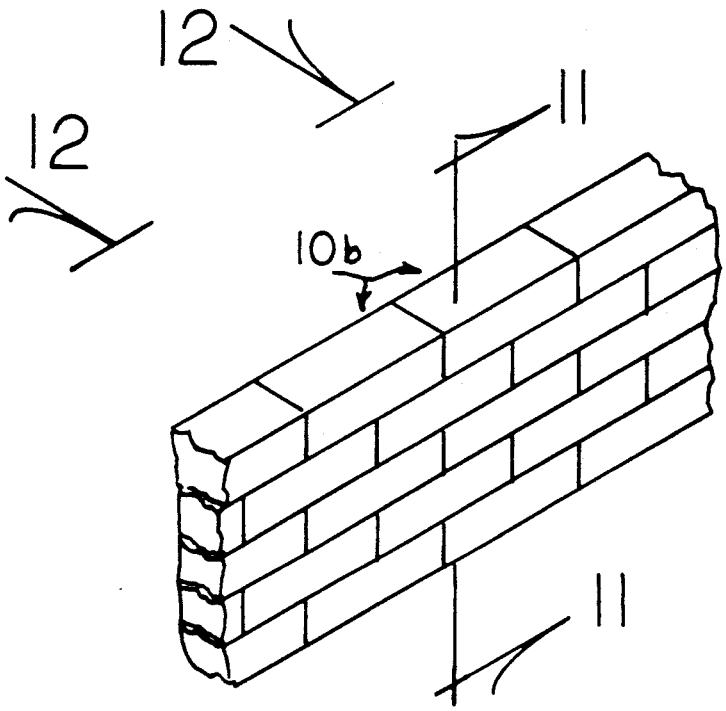
FIG. 10 is an isometric illustration of the bricks in use.
Figure 11:
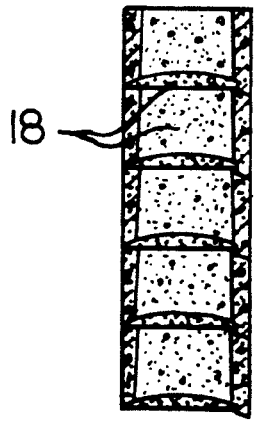
FIG. 11 is an orthographic view, taken along the lines 11—11 of FIG. 12 in the direction indicated by the arrows.
Figure 12:
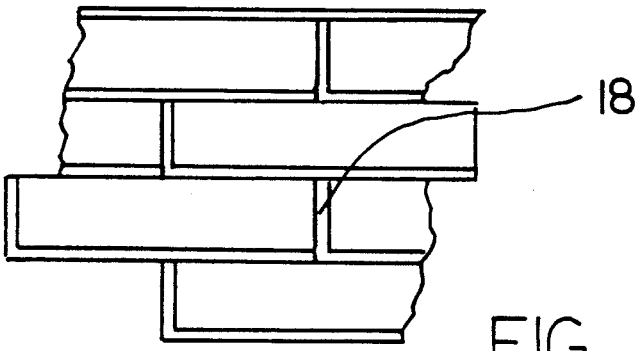
FIG. 12 is an orthographic view, taken along the lines 12—12 of FIG. 10 in the direction indicated by the arrows.

The brick structure 10*b*, as illustrated in the FIGS. 7–9, further includes a first side wall bottom edge 25 formed at a lower distal end of a first side wall flange 26, with the flange 26 extending below the linear first side wall bottom edge 21. The flange 26 includes a flange canted bottom planar surface 27 that cants rearwardly and upwardly relative to the second side wall 14 towards the arcuate first wall edge 23. First side wall flange rear surface 31 is arranged parallel relative to the second side wall 14 in confrontation to the linear first side wall bottom edge 21 and the associated concave cavity 20, with the surface 31 orthogonally oriented relative to the top wall 11. It should be noted that the top wall 11 includes a canted top wall surface 28 originating at a forward edge of the top wall extending downwardly relative to the second side wall 14 in a parallel relationship relative to the flange canted bottom planar surface 27 to accommodate a stacking of the brick structure, as illustrated in FIG. 11. Further, a second end wall flange 30 extends orthogonally beyond the second end wall 16. The surface is coplanar with the first side wall flange rear surface 31 and whose forward surface is coplanar with the second side wall 14.

The end wall flange 30 is also arranged to assist in securing of mortar between adjacent bricks, as mixtures of mortar in a condition including too much water has in the past effected seepage about the bricks requiring the extended use of man hours to effect cleaning and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling withing the scope of the invention.

What is claimed as being new and desired to be protected by Letters patent of the United States is as follows:

1. A building brick comprising, a top wall spaced from a bottom wall, and a first side wall spaced from and parallel a second side wall, and a first end wall spaced from and parallel a second end wall, and a bore directed orthogonally through the brick extending from the top wall through the bottom wall, the top wall including a top wall opening defined by a first width and a first length, and the bottom wall including a bottom wall opening defined by a second width and a second length, wherein the second width is greater than the first width and the second length greater than the first length, and the bottom wall is arcuate and defines a concave cavity, wherein the first side wall includes a first side wall bottom edge spaced from and parallel a second side wall bottom edge, and the first side wall bottom edge and the second side wall bottom edge are arranged in a parallel relationship, with the second side wall bottom edge oriented below the first side wall bottom edge as the first side wall bottom edge is spaced from the top wall a first height and the second side wall bottom edge is spaced from the top wall a second height greater than the first height, and the second side wall bottom edge defines a lower terminal edge of a second side wall flange, wherein the second side wall flange includes a second side wall flange rear surface spaced from and parallel the first side wall, and the flange includes a canted planar surface canted rearwardly and upwardly relative to the second side wall towards the cancave cavity, and the top wall includes a canted top wall surface extending from the top wall downwardly relative to the second side wall, and the canted top wall surface is oriented parallel to the flange canted bottom planar surface.

2. A brick as set forth in claim 1 including a second end wall flange orthogonally extending beyond the second end wall, wherein the second end wall flange includes a second end wall flange rear surface coplanar with the second side wall flange rear surface.

* * * * *